US009366046B1

(12) United States Patent
Rodrick

(10) Patent No.: US 9,366,046 B1
(45) Date of Patent: Jun. 14, 2016

(54) APPARATUS AND METHOD FOR COOLING SWIMMING POOL WATER

(71) Applicant: Robert M Rodrick, Lebanon, NJ (US)

(72) Inventor: Robert M Rodrick, Lebanon, NJ (US)

(73) Assignees: Robert M. Rodrick, Lebanon, NJ (US); Jonathan R. Rodrick, Port Murray, NJ (US)

( * ) Notice: Subject to any disclaimer, the term of this patent is extended or adjusted under 35 U.S.C. 154(b) by 0 days.

(21) Appl. No.: 14/576,345

(22) Filed: Dec. 19, 2014

(51) Int. Cl.
*E04H 4/00* (2006.01)
*E04H 4/12* (2006.01)

(52) U.S. Cl.
CPC ..... *E04H 4/1245* (2013.01); *E04H 4/1209* (2013.01)

(58) Field of Classification Search
CPC ..... E04H 4/129; E04H 4/12; F24F 5/0046
USPC ..... 4/488, 509, 493; 165/45, 96; 62/98
See application file for complete search history.

(56) References Cited

U.S. PATENT DOCUMENTS

| | | | | |
|---|---|---|---|---|
| 2,749,724 | A | 6/1956 | Borgerd et al. | |
| 3,399,540 | A * | 9/1968 | Kahmann | 62/98 |
| 3,970,069 | A | 7/1976 | Pickett | |
| 4,153,955 | A | 5/1979 | Hinterberger | |
| 4,189,791 | A | 2/1980 | Dundas | |
| 4,211,213 | A | 7/1980 | Nissen et al. | |
| 4,250,957 | A | 2/1981 | McClendon | |
| 4,381,763 | A | 5/1983 | Kahl | |
| 4,421,643 | A | 12/1983 | Frederick | |
| 4,616,487 | A | 10/1986 | Franklin | |
| 6,122,922 | A | 9/2000 | Conner | |
| 6,138,294 | A | 10/2000 | Desjoyaux et al. | |
| 7,624,589 | B1 | 12/2009 | Argovitz | |
| 8,820,394 | B2 | 9/2014 | Azzam | |
| 2001/0029625 | A1 | 10/2001 | Lynn | |
| 2001/0047539 | A1 | 12/2001 | Lynn | |
| 2008/0016894 | A1 * | 1/2008 | Wiggs | 62/260 |
| 2010/0155040 | A1 | 6/2010 | Hoffmann et al. | |
| 2013/0227974 | A1 | 9/2013 | Kirks | |
| 2013/0327316 | A1 | 12/2013 | Bourgeois et al. | |
| 2014/0123381 | A1 * | 5/2014 | Stephens | 4/507 |

FOREIGN PATENT DOCUMENTS

JP S57169553 A2 10/1982

* cited by examiner

*Primary Examiner* — Lauren Crane
(74) *Attorney, Agent, or Firm* — Robert M. Rodrick

(57) ABSTRACT

An apparatus and method for cooling water in a swimming pool includes a heat exchanger coupled to a return conduit of the pool filtering system. The heat exchanger is buried in the ground at a depth at which the ground temperature is substantially constant year-round thereby providing a passive heat sink for the heat exchanger. Water from the swimming pool is passed to a three-way valve for directing pool water either directly back to the swimming pool or through the heat exchanger for cooling pool water by heat transfer to the ground heat sink before being returned to the pool. A temperature sensor may be disposed within the pool water to control the operation of the valve at a predetermined pool temperature above which pool water is directed through the heat exchanger for cooling.

18 Claims, 1 Drawing Sheet

APPARATUS AND METHOD FOR COOLING SWIMMING POOL WATER

FIELD OF THE INVENTION

The subject invention relates generally to the field of swimming pools and more particularly to an apparatus and method for cooling water in a swimming pool.

BACKGROUND OF THE INVENTION

Swimming pools are enjoyed by many as a way of cooling off on hot summer days. The desired temperature of the swimming pool water for most comfortable enjoyment is in the range of about 70° F. to about 80° F. (approximately 21° C. to 27° C.). As such, controlling the water temperature to the comfort range is desirable. In cooler climates where the air temperature is typically lower, especially at night, heating the pool water with solar and other systems is well known. Such heating systems allow extended use of the swimming pool even when the temperature drops below 70° F. (21° C.).

In warmer climates, such as in the Southern United States, the ambient temperature can reach 100° F. (38° C.), or more, in the summer months. Swimming pool water in such conditions, particularly where there is no shade from the sun, can reach an uncomfortable 90° F. (32° C.), or higher, even with inground pools. Inground pools are commonly dug into the ground to depths of 8-10 feet or more to accommodate diving at the deeper portions of the pool. It is known that the temperature of the ground at a depth beginning at about five feet below ground level is substantially constant year-round, as recognized by many, including McClendon in U.S. Pat. No. 4,250,957, issued on Feb. 17, 1981. This constant temperature is in the range of approximately 55° F.-65° F. (approximately 13° C.-18° C.), depending upon the location, as noted by Azzam in U.S. Pat. No. 8,820,394, issued on Sep. 2, 2014.

While the bottom of inground pools at 8-10 feet is lower than the depth of about five feet at which the ground temperature is constant at around 55° F. (13° C.), the construction of the walls of the pool basin typically inhibits use of the lower ground temperature as a source of cooling for the swimming pool. Walls of inground pools are commonly constructed of concrete, such as Gunite material, or fiberglass, both of which are poor conductors of heat. Basin walls made of these materials thereby introduce a thermal barrier between the pool water and the ground which serves to insulate the pool water from the surrounding cool temperature of the ground. Further, manufactures often use an additional layer of insulation such as vinyl, either to the inner surface of the basin wall to keep heat in the pool water, or to the outside of the basin wall to keep the cold of the ground out. Sometimes, both inside and outside layers are used.

Certain efforts have been made to provide systems for cooling swimming pool water. One example is described by Argovitz in U.S. Pat. No. 7,624,589, issued on Dec. 1, 2009. The Argovitz apparatus comprises a cooler including a hollow tower that uses evaporative cooling principles to cool swimming pool water. Argovitz describes a number of other efforts that have been made to cool swimming pool water, which he indicates as being too costly or too complicated or cumbersome to install. Accordingly, there is interest in providing an improved system or apparatus that can effectively and inexpensively cool water in a swimming pool for the comfort of swimmers during hot weather conditions.

SUMMARY OF THE INVENTION

It is an object of the invention to provide an apparatus for cooling water in a swimming pool.

It is a further object of the invention to provide a method of cooling water in a pool by directing water from the pool though a heat exchanger buried in the ground.

DESCRIPTION OF THE EMBODIMENTS

Figure 1:
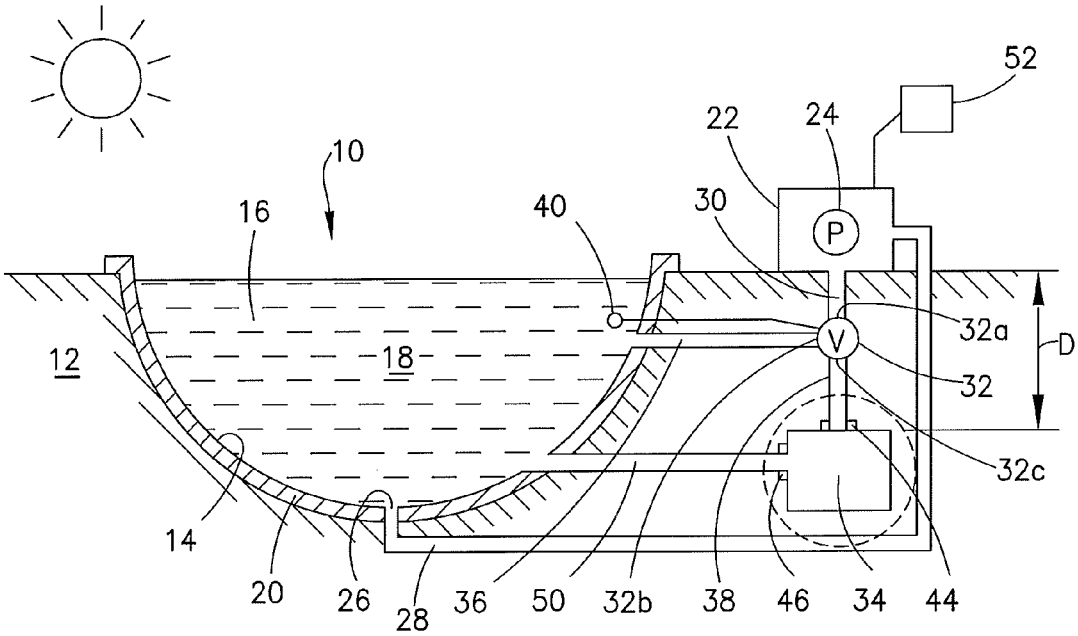
FIG. 1 is a schematic representation of a swimming pool with a filtering system in combination with an apparatus of the invention including a heat exchanger buried below ground for cooling water from the pool.

For the purposes of promoting an understanding of the principles of the invention, reference will now be made to the drawing figures and the following written description. It is understood that no limitation to the scope of the invention is thereby intend. It is further understood that the present invention includes any alterations and modifications to the illustrated arrangements and further includes applications of principles of the invention as would normally occur one skilled in the art to which this invention pertains.

Referring now to FIG. 1, an inground swimming pool 10 is shown in accordance with one arrangement of the invention. Swimming pool 10 may be dug into the ground 12 at a depth of 8 to 10 feet or more in order to allow at least a portion of the pool 10 to be used for diving. Pool 10 includes a basin 14 defining an interior volume 16 for holding swimming pool water 18, which may be up to 25,000 gallons, or more.

Basin 14 includes a wall 20 that may be may be formed of concrete, such as a Gunite material, for structurally containing water 18 within basin 14. While concrete provides flexibility for pool design and structural integrity, the thermal conductivity of concrete is typically very low. Thermal conductivity is defined as the property of a material to conduct heat, and is commonly expressed in the International System of Units (SI) as watts per meter Kelvin (W/mK). The thermal conductivity of concrete ranges from about 0.1 W/mK for lightweight concrete to about 1.8 W/mK for more dense concrete. As such, pool basin 14 formed of a wall 20 of concrete effectively establishes a thermal barrier between pool water 18 and ground 12. It should be appreciated that basin 14 may be also formed to have a wall of other suitable materials, such as fiberglass. Fiberglass also has a low thermal conductivity of about 0.04 W/mK, which would thereby also establish a thermal barrier between pool water 18 and ground 12. In addition, pool liners such as vinyl may also be used either on the interior surface of basin 14 or the exterior surface of basin 14, or both, with such liners adding to the thermal resistance already provided by either a concrete or fiberglass wall 20.

Inground pool 10 comprises a filtering system 22 that includes a pump 24 for circulating pool water 18 to and from interior volume 16, as will be further described. Filtering system 22 and pump 24 may be of conventional commercially available systems which are typically used with inground pools for circulating pool water 18 through the filtering system 22 to keep pool water 18 clean as well as to add appropriate chemicals to pool water 18 during the circulation process. Pool water 18 is withdrawn from basin 14 through a drain 26 typically located at the bottom of basin 14. A withdrawal conduit 28 is placed in communication with drain 26 and with filtering system 22 such that pool water 18 can be withdrawn from interior volume 16 by pump 24 through withdrawal conduit 28 and into and through filtering system 22. Pool water 18 may also be withdrawn from interior volume 16 by surface skimmers (not shown) that may be placed at the surface level of pool water 18, with such skimmers being in communication with withdrawal conduit 28. Filtered water 18 is returned from filtering system 22 by pump 24 to interior volume 16 through a return conduit 30 in communication with filtering system 22.

In accordance with one arrangement of the invention, a valve 32 is placed in communication with return conduit 30 for selectively directing filtered water 18 either directly back to interior volume 16 or to a heat exchanger 34 for cooling such filtered water 18, as will be described. Valve 32 is in one arrangement a three-way valve having an input 32*a*, a first output 32*b* and a second output 32*c*. Valve 32 is capable of directing pool water 18 from the filtering system 22 in two directions and operable to select one of those two directions. First output 32*b* communicates directly with interior volume 16 through conduit section 36 while second output 32*c* communicates directly with heat exchanger 34 through conduit section 38. Three-way valve 32 may be selectively operated by control devices, such as a manually operated switch, an electrical timer, or a temperature sensor. In one particular arrangement, a temperature sensor 40 communicating with valve 32 is placed within interior volume 16 of basin 14 in direct contact with pool water 18. Preferably, temperature sensor 40 is placed near the upper surface of pool water 18 about one foot below water level where the temperature of pool water 18 may be the highest when the ambient air temperature is hot, such as at 90° F. (32° C.), or above.

Valve 32 may be controlled to operate in two modes in response from an electronic signal from temperature sensor 40 based on a predetermined temperature of pool water 18. For example, when the temperature of pool water 18 is below a predetermined temperature of about 80° F. (27° C.), or other selected temperature, an electronic signal from temperature sensor 40 would allow pool water 18 exiting filtering system 22 to flow from valve input 32*a* through first output 32*b* and into said interior volume 16 while preventing water 18 from flowing through second output 32*c* into heat exchanger 34. On the other hand, when the temperature of pool water 18 is at or above the predetermined temperature of about 80° F. (27° C.), an electronic signal from temperature sensor 40 would allow pool water 18 exiting filtering system 22 to flow from valve input 32*a* through second output 32*c* into heat exchanger 34 while preventing pool water 18 from flowing through first output 32*b* into interior volume 16 of pool 10.

Figure 2:
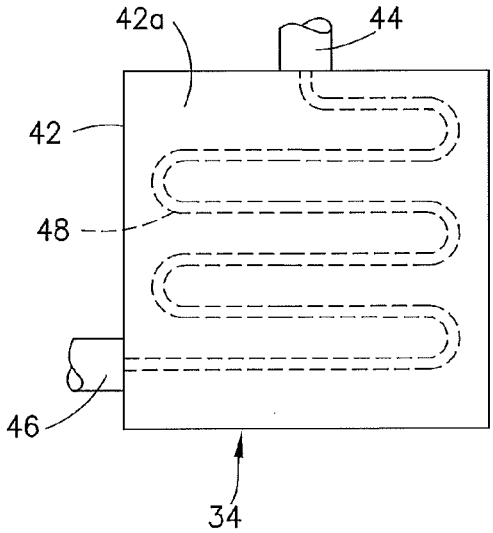
FIG. 2 is one embodiment of the heat exchanger encircled in FIG. 1.

Still referring to FIG. 1 and also now to FIG. 2, further details of heat exchanger 34 are described. Heat exchanger 34 in the arrangement shown in FIG. 2 comprises a block 42 formed of material having good thermal conductivity. Block 42 includes an input line 44, an output line 46 and a passageway 48 for circulating pool water 18 therethrough from input line 44 to output line 46. Input line 44 is coupled to second output 32*c* of valve 32 through conduit section 38. Output line 46 is coupled to conduit section 50 which is in communication with interior volume 16 for returning pool water 18 directly to interior volume 16 after circulating through heat exchanger 34. Passageway 48 may be formed as a continuous channel of serpentine loops so as to provide a desired distance for pool water 18 to flow while circulating through heat exchanger 34. The number of loops may be formed to provide the desired temperature drop of pool water 18 entering input line 44 and exiting output line 46. Channels defining passageway 48 may be circular, rectangular or any other suitable cross-section for desired flow of pool water 18 therethrough. Pool water 18 circulating through passageway 48 is in direct conductive contact with the walls of block 42 defining passageway 48 so that heat may be effectively conductively transferred from circulating pool water 18 through block 42 to the heat sink of ground 12.

Heat exchanger block 42 may be formed of two separate halves to facilitate the formation of channels defining passageway 48 therein, with such halves being then suitably joined with known fastening techniques to form a single block. In one configuration, block 42 has an outer configuration that is generally rectangular or square, it being understood that any desired configuration may be contemplated. Whatever the chosen configuration, the outer surfaces 42*a* of block 42 define an outer contact surface for being placed in direct contact with ground 12, as will be described.

In accordance with the invention, exchanger 34 is buried into the ground 12 at a depth D, as shown in FIG. 1, at which the ground temperature is substantially constant year-round, thereby defining a passive heat sink surrounding heat exchanger 34. As such, and as noted hereinabove, the depth D at which heat exchanger 34 is located is no less than about four feet and at least five feet below ground level. At such depth D the ground temperature, depending upon location, is in the range of approximately 55° F.-65° F. (approximately 13° C.-18° C.). Upon installation, contact surface 42*a* of heat exchanger block 42 is placed in direct contact with surrounding ground 12.

Conductive block 42 is selected, in accordance with the invention and as described herein, to be made of a material having good thermal conductivity. The term "good thermal conductivity" as used herein is meant to define a material having a thermal conductivity of at least about 20 W/mK, which is about the thermal conductivity of stainless steel. In a preferred arrangement, the material of block 42 is selected to have a "high thermal conductivity" which as used herein is meant to define a thermal conductivity of at least about 100 W/mK, which is about the thermal conductivity of brass. Such materials include, for example, aluminum having a thermal conductivity of about 205 W/mK, or more preferably copper, which has a thermal conductivity of about 401 W/mK. Copper is also desirable for its corrosion resistance and efficient heat absorption qualities. Variations of these metals, including copper alloys, are also desirable.

Figure 3:
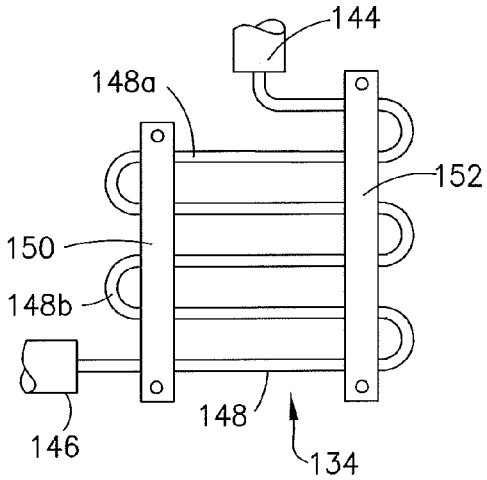
FIG. 3 is an alternative embodiment of the heat exchanger of FIG. 2

In an alternative arrangement, a heat exchanger 134 as illustrated in FIG. 3 may be used as an apparatus for cooling the temperature of pool water 18. Heat exchanger 134 comprises an input line 144, and output line 146 and a pipe 148 extending between input line 144 and output line 146, preferably in a configuration defining a continuous path of serpentine loops similar to heat exchanger 34. Input line 144 may be coupled to conduit section 38 while output line 146 may be coupled to conduit section 50. The interior opening of pipe 148 defines a passageway through which circulating water 18 is pumped from input line 144 to output line 146. Pipe 148 may be formed of a material having good thermal conductivity, or more preferably high thermal conductivity, such as copper. Pipe 148 may be constructed to have a relatively thin wall 148*a* so as to reduce the thermal resistance between the interior opening of pipe 148 and ground 12 thereby enhancing heat transfer from water 18 passing through pipe 148 to ground 12. For structural stability, pipe 148 may be secured by brackets 150 and 152, as illustrated in FIG. 3. The outer surface 148*b* of pipe 148 defines a contact surface that is placed in direct contact with ground 12 upon installation.

In use, heat exchanger 34 or 134 will only become operational when valve 32 is turned on manually by a switch, by an electrical timer or by the control of temperature sensor 40.

When temperature sensor 40 is used, a predetermined temperature such as 80° F. (27° C.) may be programmed to operate valve 32 based upon an electronic signal from temperature sensor 40 that would function in a manner similar to a house thermostat. As such, when the temperature of pool water 18 is below 80° F. (27° C.), pool water 18 pumped from filtering system 22 would pass through first output 32*b* of valve 32 and through conduit section 36 into interior volume 16 with second output 32*c* of valve 32 being closed. When the temperature of pool water 18 reaches or exceeds 80° F. (27° C.) pool water 18 pumped from filtering system 22 would pass through second output 32*c* of valve 32 and through conduit section 38 to heat exchanger 34 or 134 with first output section 32*b* being closed. It may be desirable that pool water 18 entering input line 44 or 144 at a first temperature of 80° F. (27° C.) exit output line 46 or 146 a lower second temperature of, for example, 70° F. (21° C.), so that pool water 18 entering interior volume 16 would cause pool water 18 in interior volume 16 to decrease.

The design of heat exchanger 34 or 134, including its size and number of serpentine loops may be determined from several known factors. For example, it may be desired to cool pool water 18 circulating through heat exchanger 34 or 144 by 10° F. (6° C.), i.e., from an input temperature of 80° F. (27° C.) to an output temperature of 70° F. (21° C.). With the surrounding ground 12 providing a heat sink at a constant temperature of approximately 55° F. (13° C.), and with the flow rate of the filtering system pump 24 in gallons/minute and the specific heat of pool water 18 being known, the distance that pool water 18 must flow through the heat exchanger passageway at a given cross-sectional area may be determined by using conventional heat transfer and fluid flow analysis. Adjustments may be made to any of the variable factors in the analysis to achieve the desired drop in water temperature. It should also be understood that the pool water 18 temperatures described herein are only illustrative and that other water temperatures and temperature differentials for cooling may also be considered.

Having described the particular arrangement of the apparatus and method for cooling water 18 in a swimming pool 10, it should be appreciated that variations may be made thereto without deviating from the contemplated scope of the invention. For example, it should be appreciated that heat exchanger 34 or 134 is a passive device requiring no energy for operation other than the energy for pumping water 18 therethrough. As such, use of heat exchanger 34 or 134 is environmentally desirable. To further enhance the environmental aspects of the invention, a solar panel 52, as depicted in FIG. 1 may be electrically coupled to filtering system 22 in a manner to provide suitable electricity to operate filtering system 22 and pump 24. In addition, while a single heat exchanger 34 or 134 has been described in communication with return conduit 30, it should be understood that more than one heat exchanger 34 or 134 may be coupled in tandem depending upon the amount of water to be cooled and/or the desired decrease in pool water temperature entering and exiting a heat exchanger 34 or 134. Further, while the particular pool cooling apparatus has been described in the context of an inground pool, it should be appreciated that the inventive concepts described herein may also be used with above ground pools. Lastly, while the invention has been described herein in the context of a newly installed inground pool, it should also be understood that the cooling apparatus may be used as a retrofit for previously installed pools. Accordingly, the arrangements described herein are intended to be illustrative and not limiting.

What is claimed is:

1. In combination with a swimming pool of the type including a basin defining an interior volume for holding pool water, a filtering system including a pump for circulating water to and from said interior volume, a withdrawal conduit communicating with said interior volume through which water from said interior volume is drawn by said pump to said filtering system, and a return conduit communicating with said interior volume through which filtered water is returned by said pump from said filtering system to said interior volume, an apparatus for cooling water from said interior volume comprising:

a passive heat exchanger, said heat exchanger being buried in the ground at a depth at which the ground temperature is substantially constant year-round thereby defining a heat sink surrounding said heat exchanger, said heat exchanger including an input line for receiving pool water at a first temperature from said filtering system and an output line in fluid communication with said interior volume for delivering pool water cooled by said heat exchanger through said basin and into said interior volume at a second temperature cooler than said first temperature, said heat exchanger including a contact surface in direct contact with said heat sink and being formed of a material having good thermal conductivity to transfer and dissipate heat from said water circulating through said heat exchanger to said ground heat sink to thereby cool said water from said first temperature to said second temperature; and a valve communicating with said return conduit and said input line and operative to selectively direct pool water from said filtering system directly to said interior volume of said basin or to said heat exchanger.

2. The apparatus of claim 1, further comprising a control device coupled to said valve to control the operation of said valve.

3. The apparatus of claim 2, wherein said control device is selected from the group of control devices consisting of manually operated switches, electrical timers, and temperature sensors.

4. The apparatus of claim 3, wherein said control device is a temperature sensor disposed within said interior volume of said basin in communication with said pool water to control the operation of said valve at a predetermined temperature.

5. The apparatus of claim 4, wherein said valve is a three way valve having a first output and a second output, said first output being in direct communication with said interior volume of said basin and said second output being in direct communication with said input line of said heat exchanger.

6. The apparatus of claim 5, wherein said valve is operable when said water temperature is below said predetermined temperature to allow water exiting said filtering system to flow through said first output into said interior volume while preventing water from flowing through said second output into said heat exchanger.

7. The apparatus of claim 6, wherein said valve is operable when said water temperature is at or above said predetermined temperature to allow water exiting said filtering system to flow through said second output into said heat exchanger while preventing water from flowing through said first output into said interior volume.

8. The apparatus of claim 7, wherein said heat exchanger comprises a block of material having high thermal conductivity, said block having a passageway for circulating pool water therethrough from said input line to said output line, the outer surfaces of said block defining said contact surface.

9. The apparatus of claim 8, wherein said passageway is defined by a channel formed through said block and extending from said input line to said output line in a configuration of serpentine loops.

10. The apparatus of claim 7, wherein said heat exchanger comprises a pipe of material having high thermal conductivity, said pipe having a passageway for circulating pool water therethrough from said input line to said output line, the outer surface of said pipe defining said contact surface.

11. The apparatus of claim 10, wherein said pipe is arranged in a configuration of serpentine loops from said first line to said second line.

12. The apparatus of claim 1, wherein said apparatus further comprises a solar panel communicating electrically with said filtering system to provide electricity to said filtering system and said pump.

13. A method of cooling water in a swimming pool, said swimming pool being of the type including a basin defining an interior volume for holding pool water, a filtering system including a pump for circulating water to and from said interior volume, a withdrawal conduit communicating with said interior volume through which water from said interior volume is drawn by said pump, and a return conduit communicating with said interior volume through which filtered water is returned by said pump to said interior volume, said method comprising the steps of:

burying a passive heat exchanger in the ground at a depth at which the ground temperature is substantially constant year-round, thereby defining a heat sink surrounding said heat exchanger, said heat exchanger including an input line for receiving pool water from said interior volume, an output line for delivering pool water to said interior volume and a passageway from said input line to said output line for circulating pool water therethrough, said passageway being defined by a material having high thermal conductivity, said pool water circulating through said passageway being in conductive contact with said ground heat sink through said material such that heat is transferred and dissipated from said water to said ground heat sink during circulation;

coupling said input line of said heat exchanger to be in fluid communication with said return conduit of said swimming pool;

coupling said output line of said heat exchanger to be in fluid communication with said interior volume of said swimming pool; and operating said pump to circulate pool water drawn from said interior volume through said filtering system and underground as a liquid through said heat exchanger, said pool water being received through said input line at a first temperature and returned into said interior volume through said output line at a second temperature lower than said first temperature.

14. The method of claim 13, further including the step of selectively directing water from said return conduit directly to said interior volume of said basin or directly to said input line of said heat exchanger.

15. The method of claim 14, wherein said step of selectively directing pool water is practiced by placing a valve in communication with said return conduit, said valve being capable of directing pool water in two directions and being operable to select one of said two directions.

16. The method of claim 15, wherein the operability of said valve for selectively determining one or the other of said two directions of water flow is based on the temperature of said pool water.

17. The method of claim 16, wherein said heat exchanger is buried underground at a depth of no less than about four feet.

18. The method of claim 17, wherein said heat exchanger is buried underground at a depth of at least about five feet.

* * * * *